US005193709A

United States Patent [19]

Brassell

[11] Patent Number: 5,193,709

[45] Date of Patent: Mar. 16, 1993

[54] FILTER FOR HAZARDOUS WASTE CONTAINERS

[76] Inventor: Gilbert W. Brassell, 13237 W. Eighth Ave., Golden, Colo. 80401

[21] Appl. No.: 820,833

[22] Filed: Jan. 15, 1992

[51] Int. Cl.[5] ..... B65D 51/16; B65D 90/28; B01D 46/24

[52] U.S. Cl. ..... 220/371; 220/202; 220/367; 220/373; 220/745; 220/DIG. 27; 55/510; 55/420; 137/545; 137/587

[58] Field of Search ..... 220/371, 202, 203, 208, 220/254, 367, 373, 745, DIG. 27; 55/510, 420; 137/545, 549, 550, 587, 590

[56] References Cited

U.S. PATENT DOCUMENTS

| | | | |
|---|---|---|---|
| 1,021,677 | 3/1912 | Howell | 137/545 X |
| 1,724,878 | 8/1929 | Jensen | 220/745 X |
| 2,163,262 | 6/1939 | Rhodes | 220/373 X |
| 2,710,506 | 6/1955 | Zellneger | 220/367 X |
| 2,711,252 | 6/1955 | Oliver | 137/587 X |
| 2,731,105 | 1/1956 | Nijland | 137/587 X |
| 2,789,654 | 4/1957 | Zurit . | |
| 3,048,958 | 8/1962 | Barnes | 137/587 X |
| 3,244,314 | 4/1966 | Fisher | 220/371 |
| 3,262,563 | 7/1966 | Pall | 137/545 X |
| 3,391,818 | 7/1968 | Hairston | 220/202 |
| 3,444,898 | 5/1969 | Caple | 220/367 X |
| 3,509,967 | 5/1970 | Ballard . | |
| 3,622,033 | 11/1972 | Butler et al. . | |
| 3,638,402 | 2/1972 | Thomas . | |
| 4,157,248 | 6/1979 | Queiser . | |
| 4,175,671 | 11/1979 | Holl et al. | 220/235 |
| 4,259,097 | 3/1981 | Patel et al. | 137/545 X |
| 4,884,716 | 12/1989 | Steiner | 220/202 |
| 4,886,089 | 12/1989 | Gabrlik et al. | 220/202 X |
| 4,921,071 | 5/1990 | Lonnborg et al. | 220/367 X |
| 4,959,141 | 9/1990 | Anderson | 137/549 X |

*Primary Examiner*—Allan N. Shoap
*Assistant Examiner*—Vanessa Caretto
*Attorney, Agent, or Firm*—Millen, White, Zelano and Branigan

[57] ABSTRACT

A filtered vent useful for venting drums, such as 55-gallon drums, includes a cylindrical housing having an anular activated carbon filter cartridge disposed therein. The cylindrical housing has a threaded collar with vents at one end and a pressure relief valve at the other end. The pressure relief valve is connected to a J-shaped tube which has an open end positioned proximate the threaded collar. An annular filter is disposed in the housing, the annular filter has an inner surface in communication with an inlet connected to the pressure relief valve and an outer surface in communication with the vents in the threaded collar. Volatile liquid in the air space between the top wall of the container and the top surface of the liquid passes through the activated carbon filter before venting into the atmosphere. If nesessary or desired, a HEPA filter may be disposed upstream of the activated carbon filter and a GORTEX TM film may be placed over the open end of the tube in order to protect the activated carbon filter from becoming contaminated with radioactive particulates or becoming degraded by the liquid.

16 Claims, 1 Drawing Sheet

FILTER FOR HAZARDOUS WASTE CONTAINERS

FIELD OF THE INVENTION

The instant invention relates to filters for hazardous waste containers. More particularly, the invention relates to filters useful in hazardous waste containers such as storage drums.

Large volumes of volatile organic wastes are generated by many industrial processes. These wastes may be in the form of organic liquids, aqueous solutions, solids contaminated with volatile organics or mixtures of these wastes as well as radioactive wastes in various forms. Collection, storage and transport of such waste material to a permitted toxic storage dump is a regulatory requirement.

Fifty-five gallon metal drums are routinely used as containers for the temporary storage and transportation of such wastes. These drums are frequently subject to temperature variations which cause pressurization of unvented containers and the release of hazardous vapors to the atmosphere from vented containers, resulting in the creation of hazardous conditions.

SUMMARY OF THE INVENTION

It is an object of the instant invention to provide new and improved filtered vents for containers retaining hazardous wastes.

In view of the aforementioned object and other objects, the instant invention contemplates a vent comprising a housing containing a filter material. The housing has an inlet opening at one end and an outlet opening or vent at the other end with the filter material disposed therebetween. A pressure release valve is in communication with the inlet end of the housing and is connected to a tube which extends toward the outlet of the housing. When the filtered vent is positioned in a container having a liquid phase and gaseous phase with the tube opening in the gaseous phase, pressurization of the gaseous phase due to volatization of the liquid results in venting of the container through the filter as gas in the container flows through the tube, pressure release valve, filter element and out of the housing outlet into the atmosphere.

The instant invention further contemplates utilizing the aforedescribed filter vent in combination with a container such as a storage drum wherein a filter threads into the threaded bunghole of the drum.

DETAILED DESCRIPTION

Figure 1:
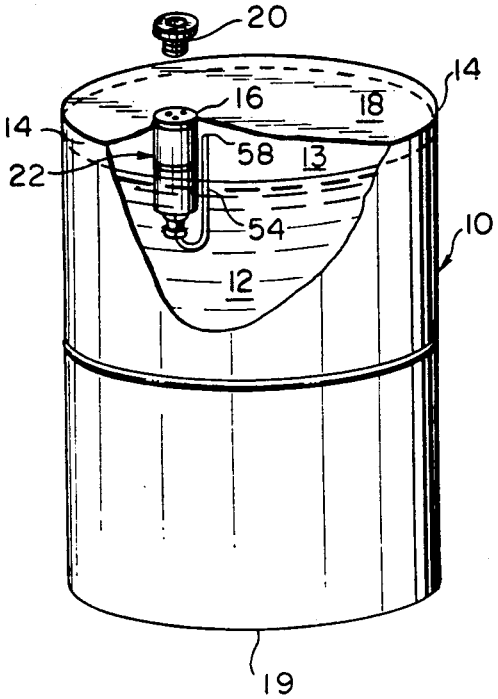
FIG. 1 is a prospective view of a drum wherein the bung plug of the drum is removed and a filtered vent configured in accordance with the instant invention is inserted into the bunghole of the drum.

Referring now to FIG. 1, there is shown a storage drum, designated generally by the numeral 10, containing liquid waste 12. Above the top level or surface 13 of the liquid waste 12, there is an air space 14 which is in essence a gas phase for a fluid system comprising the liquid and air. If the liquid 12 is a volatile liquid, then the gas phase will include material from the liquid suspended as vapor in the air 14 above the liquid. As the liquid 12 is subject to temperature variation, the gas phase 14 can become pressurized in unvented containers 10 which can lead to a hazardous situation when the containers are opened to be emptied at a toxic storage dump. If the container is a vented container, pressurization may cause the release of hazardous vapors into the atmosphere.

For most hazardous waste storage applications, the container 10 is usually in the form of a metal 55 gallon drum which includes a bunghole 16 in the top wall 18 thereof, which bunghole is normally closed with a threaded plug 20. The storage drum 10 has a bottom wall 19 upon which the drum rests which is parallel to the top wall 18 so that the top surface of the liquid is parallel to the top wall of the drum. In accordance with the instant invention, the plug 20 is removed and replaced by a filtered vent, designated generally by the numeral 22, which allows the air space 14 to vent while minimizing the amount of hazardous vapors escaping to the atmosphere.

Figure 2:
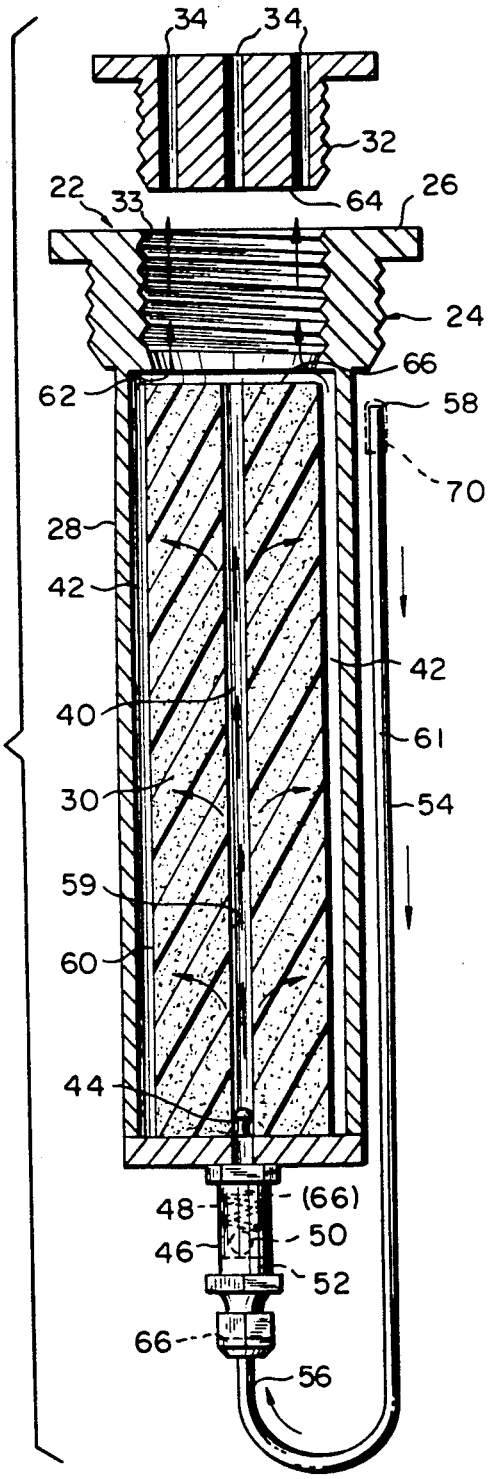
FIG. 2 is a side elevation, partially in section, showing the filtered vent in accordance with the instant invention.
Figure 3:
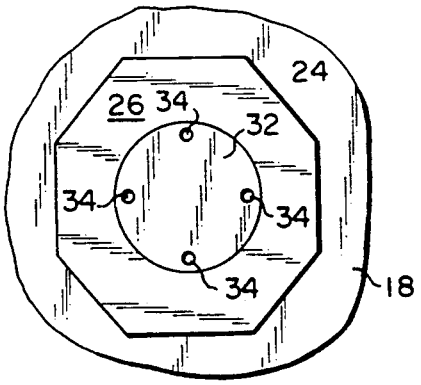
FIG. 3 is a top view of the filtered vent of FIG. 2 disposed in a portion of the top wall of the barrel of FIG. 1.

Referring now to FIGS. 2 and 3 where the filtered vent 22 is shown in detail, the filtered vent includes a threaded collar 24 which threads into the bunghole 16 in the top of the drum 18. The threaded collar 24 includes a flange 26 which bottoms proximate the top surface 18 of the drum 10 when the filtered vent 22 is completely screwed in. Attached to the collar 24 is a cylindrical housing 28 and within the cylindrical housing 28 is an annular filter 30 made of activated carbon. The annular filter 30 is preferably in the form of a replaceable cartridge so that the filtered vent structure 22 can be reused. In order to replace the filter 30 a threaded plug 32 having vent holes 34 therein is threaded into internal threads 33 of the collar 24.

The annular filter 30 has a center bore 40 and a diameter less than the housing 28 to define an annular chamber 42 between the inner wall of the housing 28 and the outer wall of the annular filter. The bore 40 is aligned with a tube 44 that is in turn in communication with a pressure relief valve 46. The pressure relief valve may contain a spring 48 which bares against a ball 50 that is seated at a valve seat 52. A J-shaped tube 54 has a first end 56 connected to the pressure relief valve 46 and a second end 58 disposed proximate the lower end of the threaded collar 24. As is seen in FIG. 1, the second end 58 of the J-shaped tube 54 opens into the air space 14 above the liquid 12 in the barrel 10. The J-shaped tube has a tubular portion 61 connecting the ends 56 and 58, which straight tubular portion extends in close proximity to the cylindrical housing 28 so as to readily fit through the long hold 16 for installation.

In operation, when the pressure in the air space 14 surpasses a pre-determined level due to volatilization of the liquid 12, the pressure relief valve 46 opens as the ball 50 unseats from the valve seat 52 against the bias of the spring 48. The air in the tube 54 having volatile liquid 12 then passes through the tube 44 into the bore 40. Since it is under pressure, the air diffuses through the inner surface 59 of the activated carbon of the filter 30 as it flows out through the outer surface 60 of the activated carbon to the annular space 42 which is at atmospheric pressure. The activated carbon filter 30 removes hazardous waste materials such as volatile organics from the air so that air in the annular chamber 42 is uncontaminated. Since the air in the annular chamber 42 is at least slightly pressurized, it flows to a space 62 between the bottom surface 64 of the plug 32 and the top surface 66 of the annular filter where it vents through ports 34 in the plug 32 to the atmosphere.

If necessary or desired, the pressure relief valve 46 can be fitted with a HEPA filter 66 disposed between the inlet of the valve and the end 56 of the tube 54 or alternatively disposed between the outlet of the valve and the tube 44 to protect the activated carbon comprising the filter 30 from radioactive contamination. In addition, the second end 58 or top of the tube 54 may be covered with a layer or GORTEX(TM) film 70 so that free liquid 12 will not enter the filter housing 28 and degrade the activated carbon in the annular filter 30, thus prolonging the life of the filter.

A preferred configuration of the filter vent 22 will have a length of about 12 inches and a diameter of about 2.5 inches so as to fit through and thread into the standard bunghole 16 in the top wall 18 of the drum 10.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A filtered vent, useful for venting a container having a liquid phase and a gas phase to an atmosphere, the filtered vent comprising:

a housing having first and second ends with a vent disposed proximate the first end of the housing;

mounting means at the first end of the housing for closing an opening in the container, through which opening the housing projects;

a pressure relief valve having first and second ends, the pressure relief valve being in communication with the second end of the housing;

a tube having first and second ends, the first end of the tube being connected to the second end of the pressure relief valve and the second end of the tube being positioned approximate the first end of the housing; and a filter in the housing disposed between the second end of the housing and the vent whereby gas under a predetermined pressure pressurizes gas within the tube which opens the relief valve allowing gas to flow through the filter and vent to the atmosphere.

2. The filtered vent of claim 1, wherein the filter is an activated carbon filter cartridge.

3. The filtered vent of claim 2, wherein the filter is an annular filter having an outer surface and a central opening defined by an inner surface and wherein the central opening is in communication with the second end of the housing, the outer surface of the filter being in communication with the first end of the housing whereby the pressurized gas flows from the central opening through the outer surface and through the vent.

4. The filtered vent of claim 1, wherein the filter is an annular filter having an outer surface and a central opening defined by an inner surface and wherein the central opening is in communication with the second end of the housing, the outer surface of the filter being in communication with the first end of the housing whereby the pressurized gas flows from the central opening through the outer surface and through the vent.

5. The filtered vent of claim 1, wherein the mounting means adjacent the first end of the housing includes a threaded collar for mating with a threaded opening in a container.

6. The filtered vent of claim 5, wherein the filter is in the form of a removable filter cartridge, wherein the collar includes an opening therethrough, and wherein the filtered vent further includes a plug receivable in the opening, which plug is removable for changing the filter cartridge.

7. The filtered vent of claim 1, further including a HEPA filer disposed between the second end of the tube and the first end of the housing to prevent the filter from being contaminated with radioactive material.

8. The filtered vent of claim 1, further including a GORTEX(TM) film filter disposed at the second end of the tube to prevent liquid from flowing into the tube and degrading the filter.

9. In combination with a storage drum having a top wall with a threaded bunghole wherein the drum is useful for containing a volatile liquid filling the drum to a top level below the top wall thereof to define a gas phase spaced between the top wall and the liquid, a filtered vent, wherein the filtered vent comprises:

a cylindrical housing having first and second ends with first and second openings at the first and second ends, respectively, and a vent disposed proximate the first end of the housing;

a threaded collar fixed to the first end of the housing, the threaded collar having vent means extending therethrough;

a normally closed pressure release valve in communication with the second opening at the second end of the housing, the pressure release valve opening when pressure applied thereto exceeds a predetermined level;

a tube having first and second ends with the first end of the tube connected to the second opening in the housing through the pressure relief valve and the second end of the tube being open and disposed in a space between the top level of the liquid and the top wall of the storage drum; and an activated carbon filter disposed in the housing, the filter having a first surface in communication with the second opening of the housing and a second surface in communication with a first opening of the housing whereby volatile liquid suspended in a gas phase is vented through the filter when pressure in the storage drum exceeds the predetermined level.

10. The combination of claim 9, wherein a HEPA filter is disposed upstream of the activated carbon filter to protect the filter from radioactive contamination if the liquid happens to contain radioactive material.

11. A combination of claim 9, wherein a GORTEX(TM) filter is placed at the second end of the tube to prevent liquid from entering the tube and degrading the activated carbon filter.

12. A combination of claim 9, wherein the activated carbon filter is in the form of a cartridge and further including an opening within the threaded collar for receiving a plug, the plug being removable in order to change the filter cartridge.

13. The combination of claim 12, wherein the vent means extending through the collar are bores in the plug.

14. The combination of claim 9, wherein the cylindrical housing is approximately 12 inches long and has a diameter of about 2½ inches so that it may be threaded into a standard bunghole.

15. The combination of claim 9, wherein the storage drum has a bottom wall upon which the storage drum rests, the bottom wall being parallel to the top wall, whereby the top level of the liquid extends generally parallel to the top of the storage drum when the drum rests on the bottom wall.

16. The combination of claim 15, wherein the tube is a J-shaped tube, the first and second ends of the tube being connected by a tubular portion which extends in close proximity to the cylindrical housing, whereby the housing and tube readily fit through the threaded bunghole.

* * * * *